US007387711B2

(12) United States Patent
Fitzpatrick et al.

(10) Patent No.: US 7,387,711 B2
(45) Date of Patent: Jun. 17, 2008

(54) SHOE PRESS BELT HAVING A GROOVED SURFACE

(75) Inventors: Keith Fitzpatrick, Dieren (NL); Bo-Christer Aberg, Halmstad (SE); Michael G. Moriarty, Ballston Lake, NY (US)

(73) Assignee: Albany International Corp., Albany, NY (US)

( * ) Notice: Subject to any disclaimer, the term of this patent is extended or adjusted under 35 U.S.C. 154(b) by 517 days.

(21) Appl. No.: 10/988,903

(22) Filed: Nov. 15, 2004

(65) Prior Publication Data

US 2005/0126733 A1 Jun. 16, 2005

Related U.S. Application Data

(60) Provisional application No. 60/523,135, filed on Nov. 18, 2003.

(51) Int. Cl.
*D21F 3/00* (2006.01)

(52) U.S. Cl. ..... 162/358.4; 162/205; 162/901; 428/167

(58) Field of Classification Search ..... 162/205–207, 162/306, 348, 358.3, 358.4, 361, 901; 100/151, 100/153; 428/163, 167, 156, 157; 442/59, 442/148

See application file for complete search history.

(56) References Cited

U.S. PATENT DOCUMENTS

| | | | |
|---|---|---|---|
| 4,427,734 | A | 1/1984 | Johnson |
| 4,482,430 | A | 11/1984 | Majaniemi |
| 4,559,258 | A | 12/1985 | Kiuchi |
| 4,567,077 | A | 1/1986 | Gauthier |
| 4,643,916 | A | 2/1987 | Kiuchi |
| 4,946,731 | A | 8/1990 | Dutt |
| 5,208,087 | A | 5/1993 | Stigberg |
| 5,238,537 | A | 8/1993 | Dutt |
| 5,360,656 | A | 11/1994 | Rexfelt et al. |
| 5,626,723 | A | 5/1997 | Schiel et al. |
| 5,792,323 | A | 8/1998 | Grondahl |
| 5,837,080 | A | 11/1998 | Grondahl |
| 5,914,007 | A | 6/1999 | Henssler et al. |
| 6,029,570 | A | 2/2000 | Matuschczyk |
| 6,030,503 | A | 2/2000 | Matuschczyk |

(Continued)

FOREIGN PATENT DOCUMENTS

| | | |
|---|---|---|
| CA | 2240793 | 12/1998 |

(Continued)

OTHER PUBLICATIONS

International Search Report and Written Opinion of the International Searching Authority issued by the European Patent Office for the corresponding international application (PCT/US2004/038045) mailed Apr. 12, 2005.

*Primary Examiner*—Eric Hug
(74) *Attorney, Agent, or Firm*—Frommer Lawrence & Haug LLP; Ronald R. Santucci

(57) ABSTRACT

A belt for use in a long nip press having an arcuate pressure shoe. The belt has at least one layer having a polymer resin coating on at least one surface thereof. The resin coating has a plurality of grooves arranged therein and wherein a number of the grooves has a length less than a length of the arcuate pressure shoe to reduce ingoing nip spray.

52 Claims, 14 Drawing Sheets

U.S. PATENT DOCUMENTS

| | | | | |
|---|---|---|---|---|
| 6,428,874 | B1 | 8/2002 | McGahern et al. | |
| 6,835,286 | B2 * | 12/2004 | Honkalampi et al. | 162/358.4 |
| 6,854,301 | B1 * | 2/2005 | Romanski | 69/48 |
| 7,097,741 | B2 | 8/2006 | Watanabe et al. | |
| 2004/0112561 | A1 | 6/2004 | Watanabe et al. | |
| 2005/0274475 | A1 | 12/2005 | Hikida | |

FOREIGN PATENT DOCUMENTS

| | | | |
|---|---|---|---|
| DE | 44 01 580 | A | 6/1994 |
| DE | 44 11 621 | A | 10/1995 |
| DE | 44 45 472 | A | 6/1996 |
| DE | 197 52 725 | A | 6/1999 |
| EP | 0 886 004 | A1 | 12/1998 |
| JP | 8-13373 | * | 1/1996 |
| JP | 3053334 | | 4/2000 |

* cited by examiner

SHOE PRESS BELT HAVING A GROOVED SURFACE

CROSS-REFERENCE TO RELATED APPLICATIONS

This application is based upon and claims the benefit of U.S. Provisional Patent Application Ser. No. 60/523,135 filed Nov. 18, 2003 entitled "SHOE PRESS BELT HAVING A GROOVED SURFACE", the disclosure of which is incorporated herein by reference.

BACKGROUND OF THE INVENTION

1. Field of the Invention

The present invention relates to mechanisms for extracting water from a web of material, and, more particularly, from a fibrous web being processed into a paper product on a papermaking machine.

2. Description of the Related Art

During the papermaking process, a fibrous web of cellulosic fibers is formed on a forming wire by depositing a fibrous slurry thereon in the forming section of a paper machine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entering the dryer section. As the dryer drums are often heated from within by steam, costs associated with steam production can be substantial, especially when a large amount of water needs to be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the web takes longer to pass through a long press nip than through one formed by press rolls. The longer the time a web can be subjected to pressure in the nip, the more water can be removed there, and, consequently, the less water will remain behind in the web for removal through evaporation in the dryer section.

The present invention relates to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip which can be five to ten times longer in the machine direction than one formed between two press rolls is formed. Since the long nip is five to ten times longer than that in a conventional two-roll press, the so-called dwell time of the fibrous web in the long nip is correspondingly longer under the same level of pressure per square inch in pressing force used in a two-roll press. The result of this long nip technology has been a dramatic increase in dewatering of the fibrous web in the long nip when compared to conventional nips on paper machines.

A long nip press of the shoe type requires a special belt, such as that shown in U.S. Pat. No. 5,238,537. This belt is designed to protect the press fabric supporting, carrying and dewatering the fibrous web from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web.

The base fabric of the belt shown in U.S. Pat. No. 5,238,537 may be woven from monofilament yarns in a single- or multilayer weave, and woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat-woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 13 to 35 feet (approximately 4 to 11 meters), measured longitudinally around their endless-loop forms, and widths from roughly 100 to 450 inches (approximately 250 to 1125 centimeters), measured transversely across those forms. It will be appreciated that the manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, the internal stresses which arise when the belt is flexed on passing around a roll or the like on a paper machine will be less likely to cause the coating to delaminate from either side of the belt.

Moreover, when the outer surface of the belt has a resin coating of some predetermined thickness, it permits grooves, blind-drilled holes or other cavities or voids to be formed on that surface without exposing any part of the woven base fabric. These features provide for the temporary storage of water pressed from the web in the press nip. In fact, for some long nip press configurations the presence of some void volume, provided by grooves, blind-drilled holes or the like, on the outer surface of the belt is a necessity.

Long nip press belt having a plurality of grooves are known. For example, U.S. Pat. No. 4,946,731 to Dutt shows such a long nip press belt, which has a base fabric which includes, in at least one of the machine and cross-machine directions, a spun yarn of staple fibers. When the base fabric is coated with a polymeric resin material, individual staple fibers extend from the spun yarns outward into the surrounding coating material. Subsequently, machine-direction grooves are cut into the coating on the outer surface of the belt. The so-called land areas separating the grooves from one another are anchored to the belt by these staple fibers, which make them less susceptible to delamination.

Another example, U.S. Pat. No. 6,428,874 to McGahern et al. shows a resin-impregnated endless belt for a long nip press of the shoe type that has a base structure impregnated by a polymeric resin material which renders the belt impermeable to fluids, such as oil, water and air. The polymeric resin material forms layers on the inner and outer sides of the base structure. The inner layer is smooth, but the outer layer has primary grooves for the temporary storage of water pressed from a paper web. The primary grooves are separated by land areas which have secondary grooves extending there across to relieve stresses which give rise to flex fatigue and stress cracking.

Accordingly, shoe press belts which are constructed with a grooved surface offer many advantages over belts without grooves, e.g. improved water removal, improved sheet profile, improved felt conditioning and felt lifetime. But in a number of applications, particularly on a slower speed paper machine, the advantages of using a grooved belt are less clear. Specifically, in applications where the press exhibits an ingoing nip spray (especially in the case of an inverted press) it may be more advantageous to use blind drilled circular holes on the surface of the belt rather than the above-described grooved belts. That is, ingoing nip spray is caused when the press fabric enters the pressure nip. Water is pressed out of the web by the press roll and into the press fabric and subsequently into the grooves. Because the grooves are continuous through the length of the belt, water is sprayed at the ingoing and outgoing nip ends. Ingoing nip spray leads to a loss of void volume in the press fabric, resulting in reduced web dewatering.

The present invention provides a solution to this problem by providing a shoe press belt with a grooved surface wherein the length of a number of a grooves may not be continuous and may be less than the length of the arcuate pressure shoe of the long nip press. The area of the press nip associated with the highest nip pressure (and highest water removal) is prior to the nip exit. As the groove exits the nip, the groove opening may not be present at the nip entrance or the nip entrance may be blocked because the length of the groove is less than the length of the arcuate pressure shoe and thus less than the length of the pressure nip. Since the nip entrance is blocked (not vented to the atmosphere) ingoing nip spray is reduced or eliminated, and hydraulic pressure within the press fabric is increased resulting in effective water removal from the web as the groove segment in the belt surface exits the nip. Accordingly, the discontinuous grooves of the present invention reduce or eliminate ingoing nip spray and increase the efficiency of dewatering.

The grooves of the above-mentioned present belt may extend in a direction substantially parallel to the machine direction (MD). Alternatively, the grooves of the present belt may be oriented in the cross-machine direction (CD) of the belt surface, and may be continuous or discontinuous.

SUMMARY OF THE INVENTION

Accordingly, the present invention is a belt which may be used with a long nip shoe press. The belt comprises at least one layer, e.g. a base structure, which may be in the form of an endless loop. The long nip press may have an arcuate pressure shoe. A polymeric resin material impregnates or coats at least one surface of a layer of the belt and forms an outer layer or coating thereon. The outer layer may have a plurality of grooves oriented generally in the machine direction (MD), a number of grooves having a length less than the length of the arcuate pressure shoe.

In other embodiments, the present belt includes a plurality of continuous or discontinuous grooves oriented substantially in the cross-machine direction (CD).

The present invention will now be described in more complete detail with reference being made to the figures wherein like reference numerals denote like elements and parts, which are identified below.

DETAILED DESCRIPTION OF THE PREFERRED EMBODIMENT

Figure 1:
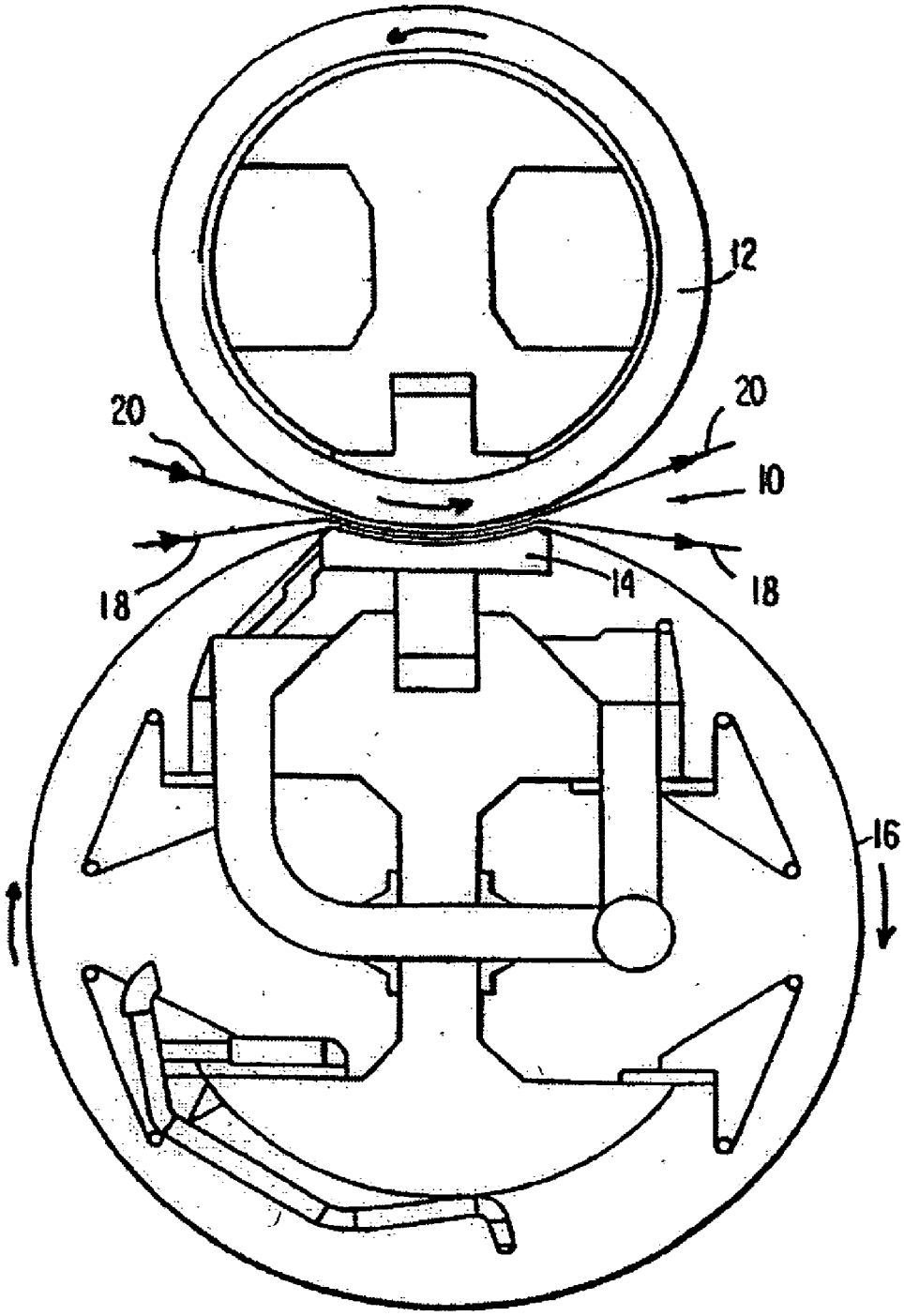
FIG. 1 is a side cross-sectional view of a long nip press.

A long nip press for dewatering a fibrous web being processed into a paper product on a paper machine is shown in a side cross-sectional view in FIG. 1. Press nip 10 is defined by smooth cylindrical press roll 12 and arcuate pressure shoe 14. Arcuate pressure shoe 14 has about the same radius of curvature as cylindrical press roll 12. The distance between cylindrical press roll 12 and arcuate pressure shoe 14 may be adjusted by hydraulic means or the like operatively attached to arcuate pressure shoe 14 to control the loading of the nip 10. Smooth cylindrical press roll 12 may be a controlled crown roll matched to arcuate pressure shoe 14 to obtain a level cross-machine nip pressure profile.

Long nip press belt 16 extends in a closed loop through nip 10, separating cylindrical press roll 12 from arcuate pressure shoe 14. Press fabric 18 and fibrous web 20 being processed into a paper sheet pass together through nip 10 as indicated by the arrows in FIG. 1. Fibrous web 20 is supported by press fabric 18 and comes into direct contact with smooth cylindrical press roll 12 in nip 10. Alternatively, fibrous web 20 may pass through nip 10 sandwiched between two press fabrics 18 (second press fabric not shown). Long nip press belt 16, also moving through press nip 10 as indicated by the arrows, that is, clockwise as depicted in FIG. 1, protects press fabric 18 from direct sliding contact against arcuate pressure shoe 14, and may slide over the arcuate pressure shoe on a lubricating film of oil. Long nip press belt 16, accordingly, may be impermeable to oil, so that press fabric 18 and fibrous web 20 will not be contaminated thereby.

Figure 2:
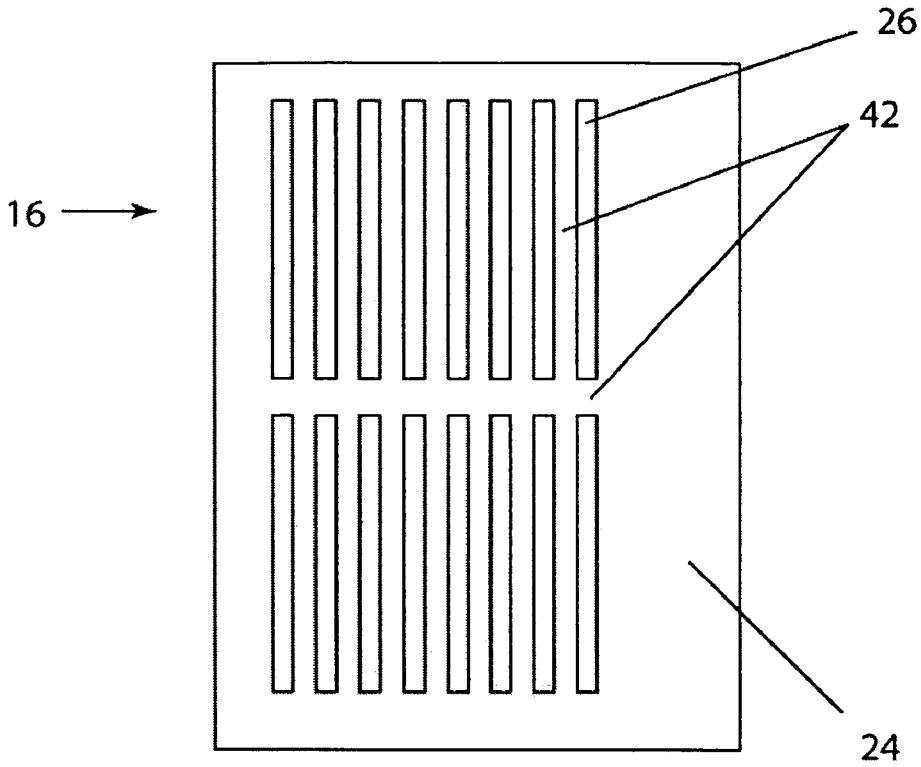
FIG. 2 is a top view of a belt having a plurality of grooves which are arranged in accordance with an embodiment of the present invention.

FIG. 2 is a top view of a belt 16 in accordance with an embodiment of the present invention. Belt 16 has outer surface 24. Outer surface 24 is provided with a plurality of grooves 26 extending in the machine direction around the belt 16 for the temporary storage of water pressed from fibrous web 20 in press nip 10. Grooves 26 will be discussed in more detail below.

Figure 3:
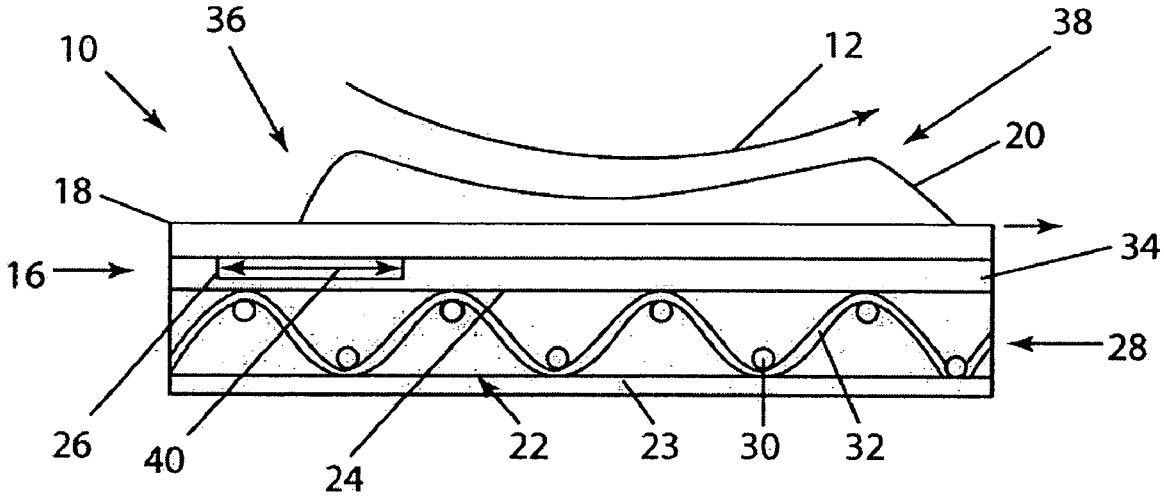
FIG. 3 is a cross-sectional view of FIG. 1 which illustrates the groove entering a nip.
Figure 4:
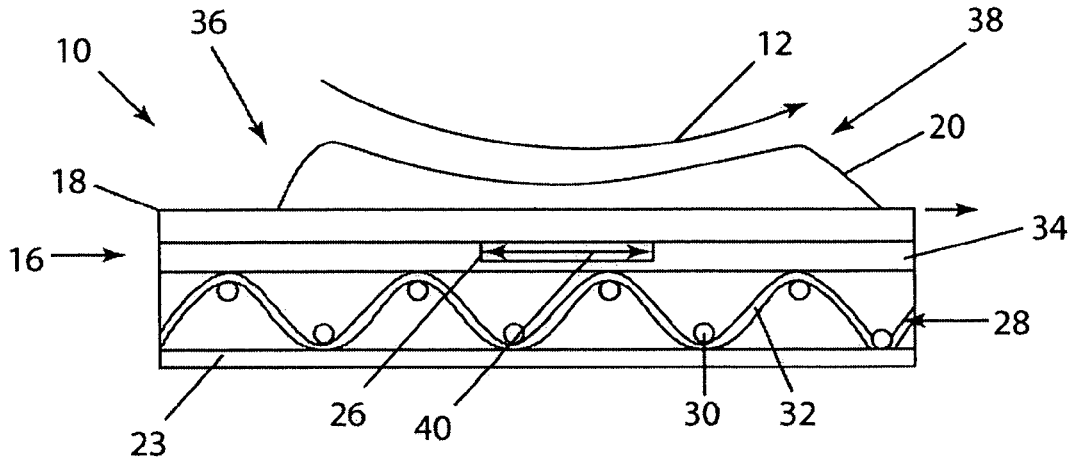
FIG. 4 is a cross-sectional view of FIG. 1 which illustrates the groove enclosed by the nip.
Figure 5:
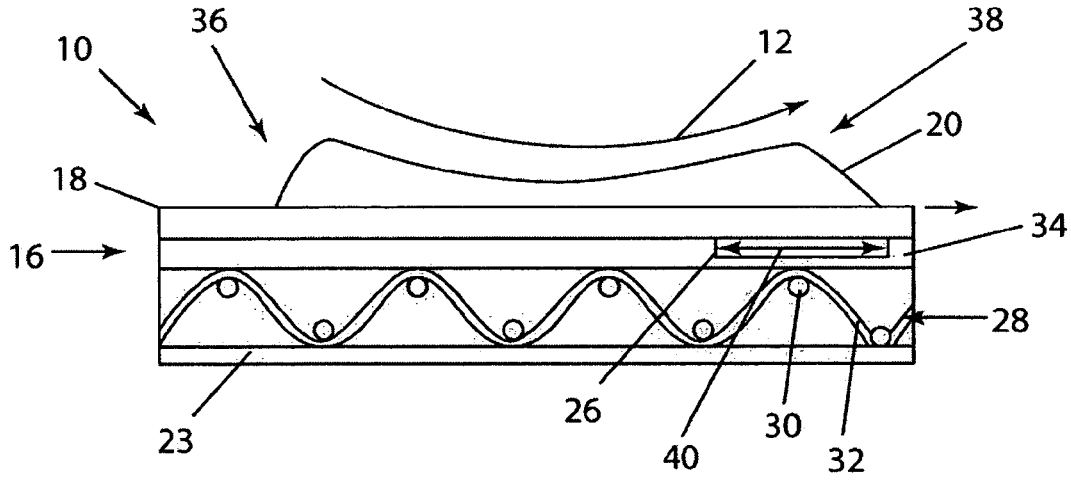
FIG. 5 is a cross-sectional view FIG. 1 which illustrates the groove exiting the nip.

FIGS. 3-5 show the dewatering mechanism in shoe press nip 10 in three phases, in which one of the grooves 26 enters and exits press nip 10. FIG. 3 is a cross-sectional view of the belt 16 as groove 26 enters nip 10. As shown in the progression of FIGS. 3-5, groove 26 enters nip 10 at nip entrance 36 and exits nip 10 at nip exit 38.

FIG. 3 also shows a cross-section of belt 16. Belt 16 may include at least one base layer 28. However, belt 16 may contain additional layers in addition a polymer resin coating 34.

Layer 28 may be woven from transverse, or cross-machine direction yarns 30 (viewed from the side in FIG. 3), and longitudinal or machine-direction yarns 32. Layer 28 may be woven, the transverse yarns 30 being warp yarns weaving over, under and between longitudinal yarns 32, the weft yarns are in a single weave. It should be understood, however, that layer 28 may be flat woven, and subsequently joined into endless form with a seam. It should be further understood that layer 28 may be woven in a duplex weave, or in any other weave which may be used in the production of paper machine clothing belts.

Layer 28 may alternatively be a nonwoven structure in the form of an assembly of transverse and longitudinal yarns, which may be bonded together at their mutual crossing points to form a fabric. Further, layer 28 may be a knitted or braided fabric, or a spiral-link belt of the type shown in U.S. Pat. No. 4,567,077 to Gauthier, the teachings of which are incorporated herein by reference. Layer 28 may also be extruded from a polymeric resin material in the form of a sheet or membrane, which may subsequently be provided with apertures. Alternatively still, at least one layer 28 may comprise nonwoven mesh fabrics, such as those shown in commonly assigned U.S. Pat. No. 4,427,734 to Johnson, the teachings of which are incorporated herein by reference.

Further, layer 28 may be produced by spirally winding a strip of woven, nonwoven, knitted, braided, extruded or nonwoven mesh material according to the methods shown in commonly assigned U.S. Pat. No. 5,360,656 to Rexfelt et al., the teachings of which are incorporated herein by reference. Layer 28 may accordingly comprise a spirally wound strip, wherein each spiral turn is joined to the next by a continuous seam making the base structure 28 endless in a longitudinal direction. A press belt having a base structure of this type is disclosed in commonly assigned U.S. Pat. Nos. 5,792,323 and 5,837,080, the teachings of which are incorporated herein by reference.

A resin, such as a polymer resin, 34 is coated, impregnated or otherwise disposed on at least one surface of belt 16. Polymer resin 34 may be coated or otherwise disposed on outer surface 24 of belt 16, that is, the surface which contacts press fabric 18 when belt 16 is in use on a long nip press. In addition, a polymer resin layer 23 may be coated or otherwise disposed on inner surface 22 of belt 16, that is, the surface which slides over the arcuate pressure shoe 14 when belt 16 is in use on a long nip press. The polymeric resin layer 23 may impregnate layer 28, and render belt 16 impermeable to oil, water, and the like. Polymeric resin coating 34 and 23 may be polyurethane, and may be a 100% solids composition thereof. The use of a 100% solids resin system, which by definition lacks a solvent material, avoids the formation of bubbles in the polymeric resin during the curing process through which it proceeds following its application onto layer 28.

Inner surface 22 and/or outer surface 24 may also be ground and buffed after the polymeric resin has been cured to provide the polymeric resin coating with a smooth, uniform surface.

After the polymeric resin has been cured, grooves 26 may be cut into outer surface 24 of belt 16. Alternatively, grooves 26 may be pressed into outer surface 24 by a pressing-type device before the polymeric resin has been cured, or may be molded into outer surface 24 (such as when belt 16 is manufactured using a molding process). As is to be appreciated, other possible way to form grooves 26 would readily be apparent to one skilled in the art.

Further, in at least one embodiment of the present invention, grooves 26 are not continuous. That is the grooves 26 are separated by a land area 42 which is the ungrooved area between adjacent (and for that matter successive) grooves. The grooves 26 may be formed in either the machine direction of the belt or the cross-machine direction of the belt. In one preferred embodiment with grooves formed in the machine direction, shown in FIGS. 3-5, the grooves 26 are formed in the machine direction of the belt and have a length 40 such length may have a value which is less than the length of the shoe 14 (of FIG. 1), such as approximately, one-third, one-half, two-thirds, etc. of the length of the shoe. As an example, if the length of a typical arcuate pressure shoe is approximately 250 mm, the length 40 of groove 26 may be approximately 125 mm. Similarly, in FIG. 11 there is shown the embodiment where the grooves 26 are formed in the cross-machine direction.

The shape, dimensions, spacing, and orientation of grooves 26 may vary in accordance with the long nip press application and/or the desired ingoing nip spray relief and efficiency of the dewatering process.

As mentioned above and shown in FIG. 3, groove 26 enters nip 10 at nip entrance 36 and exits nip 10 at nip exit 38. Nip entrance 36 is characterized as a low pressure zone. As fibrous web 20 enters nip 10, the pressure applied from roll 12 and shoe 14 forces water contained in web 20 to flow into press fabric 18 which is in contact with belt 16. Groove 26 then accepts the water from press fabric 18.

FIG. 4 is a cross-sectional view of the belt 16 as groove 26 is enclosed by nip 10. Groove 26 now enters a hydrostatic zone where the water from the web 20 and the press fabric 18 are under pressure. Groove 26 accepts water until its void volume is completely filled.

FIG. 5 is a cross-sectional view of the belt 16 as groove 26 exits nip 10. Nip exit 38 is characterized as a high pressure zone. The highest pressure and thus highest water removal is near nip exit 38. Because groove 26 is not continuous and is less than the length of the arcuate pressure shoe 14, the groove does not extend to the nip entrance or in other words the nip entrance 36 is blocked, and water that is removed from web 20 and forced through press fabric 18 into belt 16 builds up hydrodynamic pressure as discussed above with regard to FIG. 4. This build up of hydrodynamic pressure forces the water to exit groove 26 when it exits nip 10 at nip exit 38. Accordingly, high pressure drives water flow from web 20 and press fabric 18 to now exposed groove 26.

FIGS. 2, 6, and 7, 7*a* and 7*b* illustrate several arrangements of grooves. As shown in FIG. 2, grooves 26 may be arranged in a equal number of rows wherein a line intersecting the ends of each groove in a row is substantially perpendicular to the longitudinal direction. However, the number of grooves in a row and distances between adjacent rows in the longitudinal direction on belt 16 may vary in accordance with the long nip press application, and/or the desired ingoing nip spray relief and efficiency of the dewatering process. As mentioned above, grooves 26 may not be continuous in length in the longitudinal direction and may be less than the length of the arcuate pressure shoe 14. Grooves 26 are separated from one another by land areas 42, as shown in FIG. 2.

Figure 6:
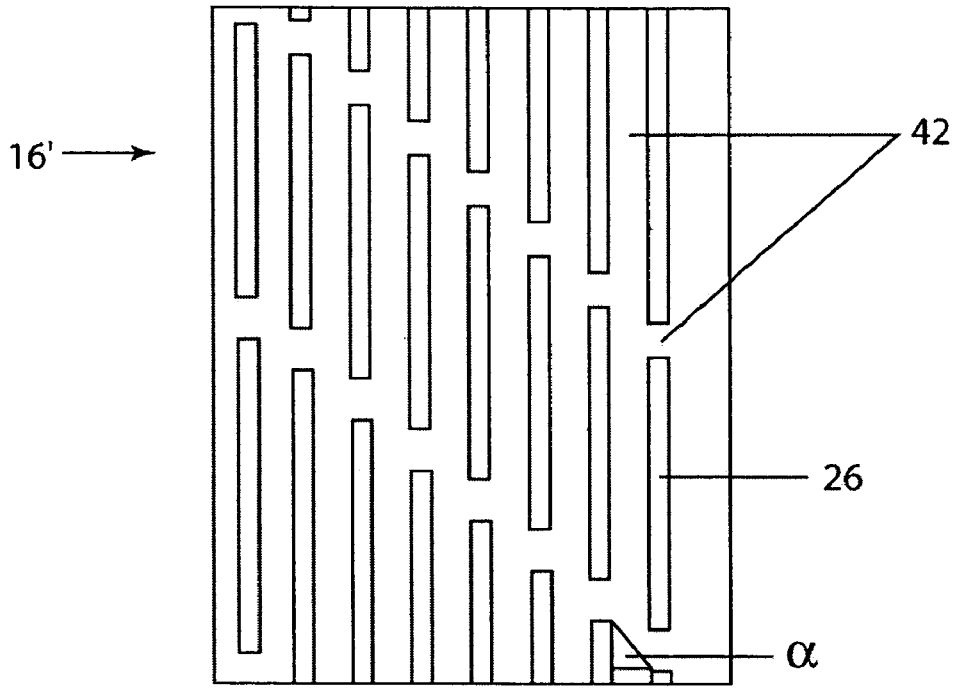
FIG. 6 is a top view of a belt having a plurality of grooves which are arranged in accordance with an embodiment of the present invention.

FIG. 6 is a top view of a belt 16' in accordance with another embodiment of the present invention. In this example, MD grooves 26 are formed in staggered rows having a uniform offset. The offset is shown as an angle $\alpha$. Angle $\alpha$ may be, for example, 25-30°.

Figure 7:
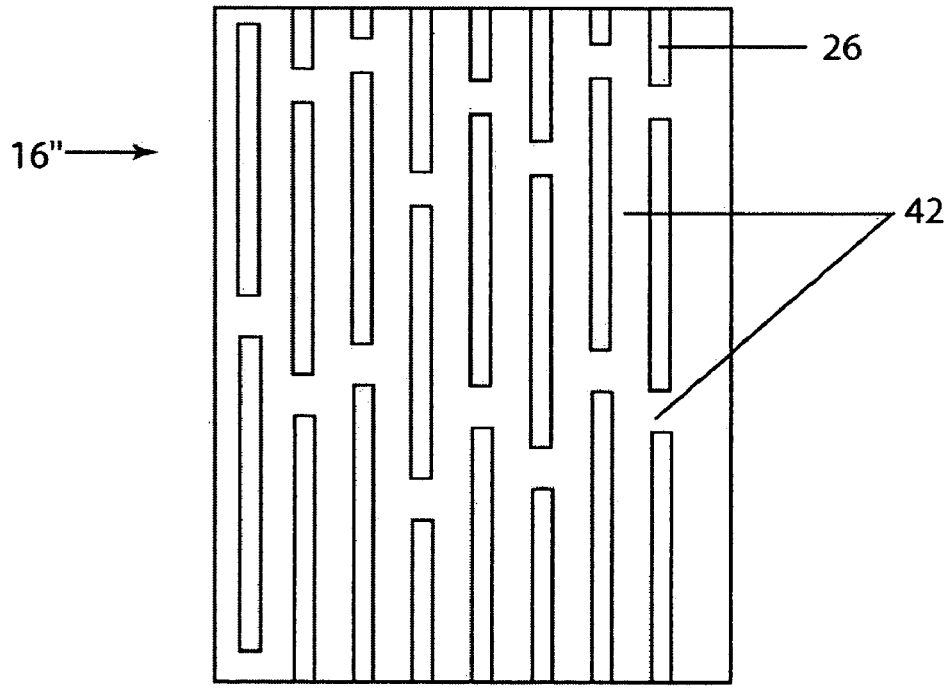
FIG. 7 is a top view of a belt having a plurality of grooves which are arranged in accordance with an embodiment of the present invention.

FIG. 7 is a top view of a belt 16" in accordance with another embodiment of the present invention. Here, MD grooves 26 are formed in staggered rows in a non-repeating transverse pattern. Other embodiments may also include a repeating pattern of staggered rows.

Figure 7A:
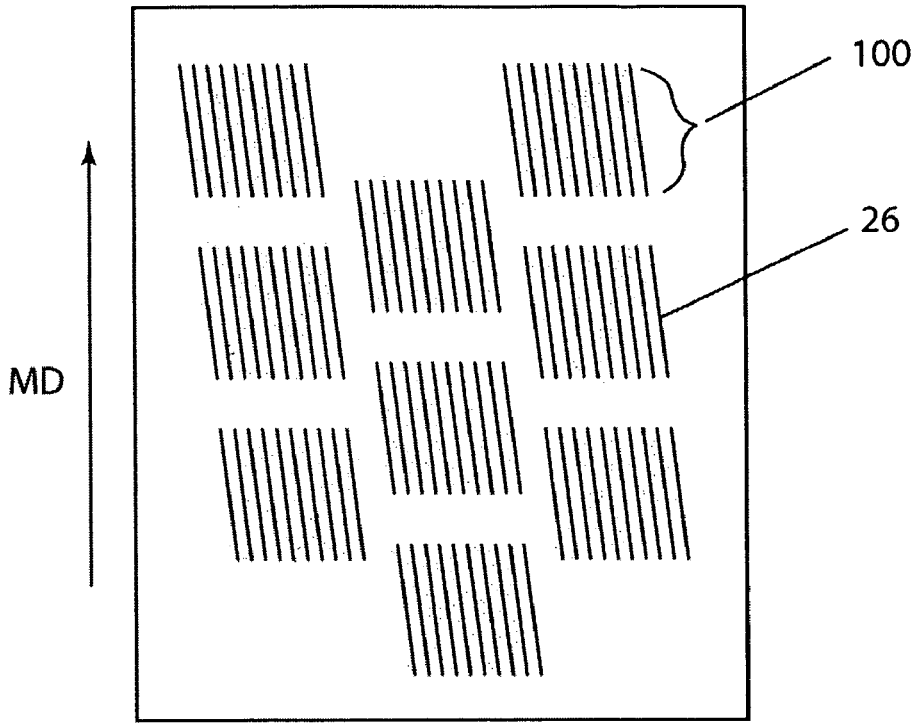
FIG. 7*a* is a top view of a belt having a plurality of grooves which are arranged in accordance with an embodiment of the present invention.
Figure 7B:
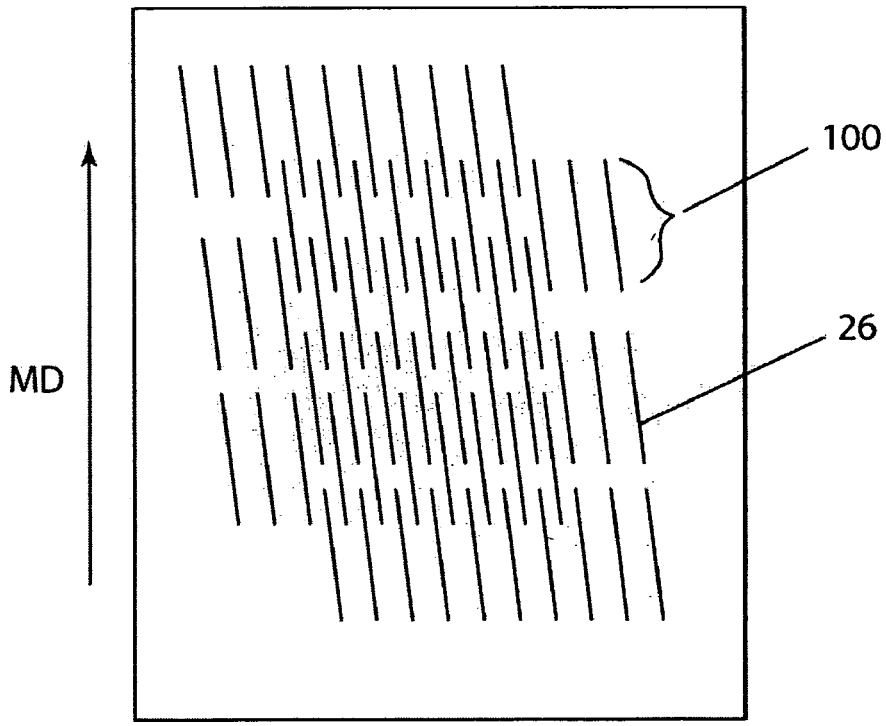
FIG. 7*b* is a top view of a belt having a plurality of grooves which are arranged in accordance with an embodiment of the present invention.

FIG. 7*a* depicts yet another groove pattern in the machine direction where a plurality of grooves are formed in repeatable clusters or patterns 100. As shown in FIG. 7*a*, the clusters 100 of discontinuous grooves 26 comprise, for example, ten grooves extending substantially in but at an angle to the machine direction. Such grooves can be cut by what is known as "gang cutters" typically cut in a spiral fashion. The belt includes as many groove clusters 100 as desired for proper dewatering characteristics of the belt. Although the clusters are shown at an angle to the machine direction other orientations are considered within the scope of the present invention including in the cross-machine direction. Further, although the clusters 100 are all shown with the same orientation, the present invention is not limited thereby, rather it may include clusters formed in a variety of orientations on the same belt. FIG. 7*b* shows still a further embodiment of the present invention having overlapping grooves 26 formed in a belt. The overlapping grooves 26 result in the discontinuous grooves encircling the entirety of the belt in a repeat pattern. Again, the grooves 26 shown in FIG. 7*b* are shown angled to the machine direction, but may be formed in any orientation including in the cross-machine direction. By having some grooves at varying distance along the length of the belt, the incidence of marking caused by a portion of the belt without any grooves is reduced.

In an embodiment of the present invention, the length of groove 26 in the machine direction may be any length up to approximately the shoe length. For example, the groove 26 may have a length of approximately 50 mm and the distance between grooves 26 in the longitudinal direction may be approximately 25 mm. Further, grooves 26 and land areas 42 may be arranged in any pattern that minimizes potential for hydraulic disruption or marking of the paper sheet. Grooves 26 and land areas 42 are depicted in FIGS. 2, 6 and 7 as being of equivalent width, although this need not be the case. Nevertheless, land areas 42 may be thought of as narrow pillars of cured polymeric resin aligned in the machine direction on outer surface 24 of the belt.

MD grooves 26 have been described in the preceding discussion as being oriented in the machine, or longitudinal, direction. The grooves 26 may be provided by cutting discontinuous grooves which spiral on outer surface 24. In such a situation, the orientation of the grooves 26 may deviate from the machine, or longitudinal, direction by a small angle. In addition, grooves 26 may be provided by cutting two or more adjacent discontinuous grooves which spiral on outer surface 24 in opposite directions, that is, one describing a right-handed spiral and the other describing a left-handed spiral. The cutters may be intermittently removed from the belt surface forming a short horizontal strip of land area in the cross-direction (CD strip). The CD strip may be randomized over the surface of the belt depending on the length of the belt, the length of the groove and the length of the land area.

In one advantageous embodiment of the present invention, grooves 26 may have a depth of approximately 1.4 mm, and a width in the range from 0.5 mm to 2.0 mm. Each groove 26 may be separated from the next by a distance (land width) in the transverse direction in a range from 1.0 mm to 2.5 mm. However, the precise number, depth, width, and shape of grooves 26 as well as the width of land areas 42 may vary depending on the desired application. Accordingly, there is a wide range of groove-to land area ratio.

Although the grooves have been described as running in a longitudinal or machine direction, the present invention is not so limited. That is, the grooves could be arranged in any other direction, such as in a transverse or CD direction, or in a direction which is at an angle $\theta$ (such as $0<\theta<90°$) relative to the machine direction. In such situation, the "length" of the grooves 26 may be shorter than the width of the shoe as, for example, shown in FIGS. 11 and 12.

Figure 11:
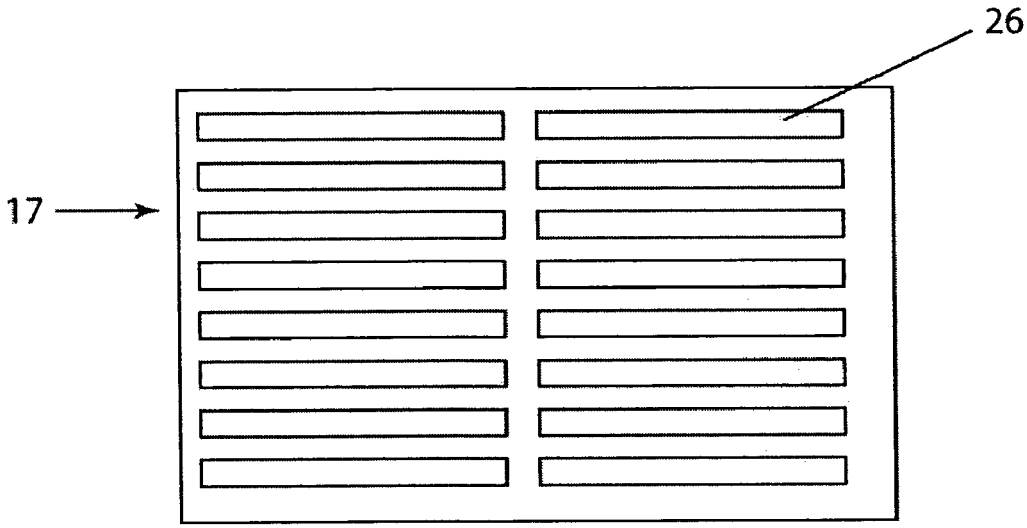
FIG. 11 is a top view of a belt having a plurality of grooves which are arranged in accordance with an embodiment of the present invention.
Figure 11A:
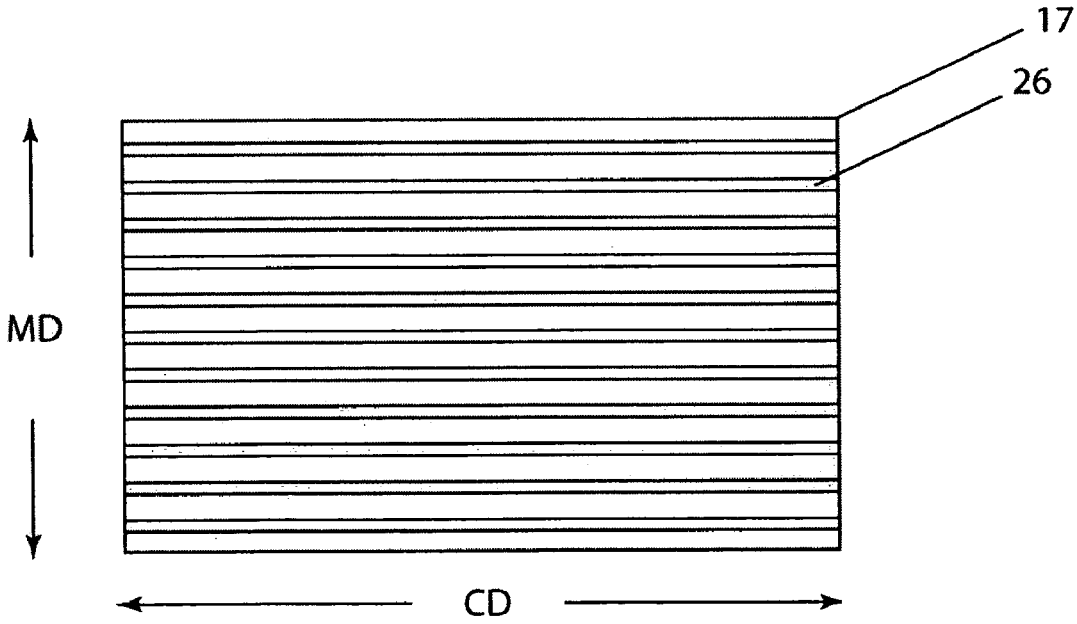
FIG. 11*a* is a top view of a belt having a plurality of grooves which are arranged in accordance with an embodiment of the present invention.
Figure 12:
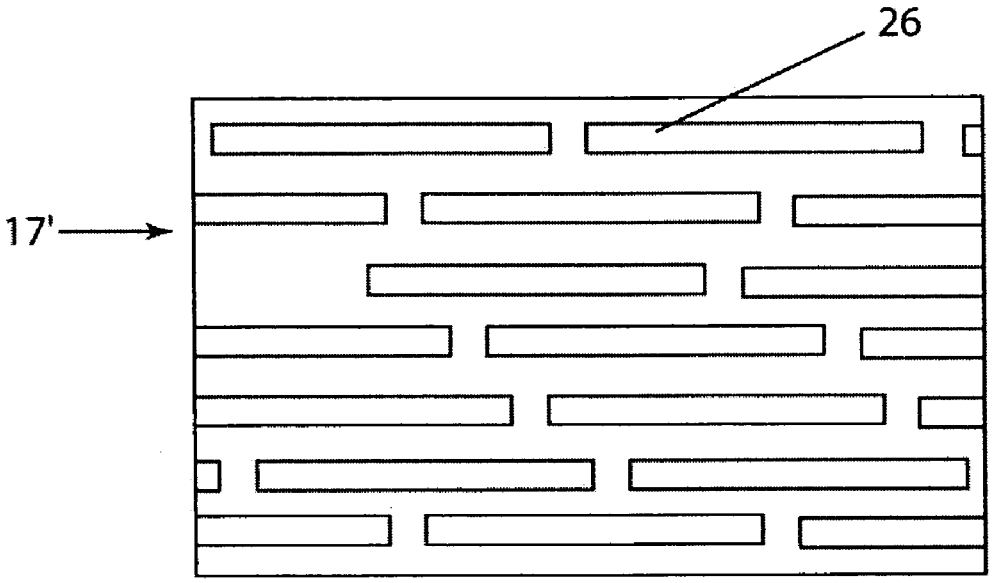
FIG. 12 is a top view of a belt having a plurality of grooves which are arranged in accordance with an embodiment of the present invention.

As shown in FIG. 11, grooves 26 may be arranged in a number of columns wherein each groove is formed in substantially the transverse or CD direction. However, the number of grooves in a column and distances between adjacent columns in the CD or transverse direction on belt 17 may vary in accordance with the application and/or the desired ingoing nip spray relief and efficiency of the dewatering process. Such grooves 26 may be considered as being non-continuous in length in the transverse direction and may have a width (MD component) less than the length of the arcuate pressure shoe 14. Alternatively, the CD grooves may be continuous as shown in FIG. 11*a*, where the grooves 26 extend substantially the entire cross-machine width of the belt 17. The belt 17 may also include a plurality of discontinuous machine direction grooves 26 formed in the resin coating layer. The grooves 26 may also be formed of a combination of two or more groove features selected from the group consisting of groove shape, width, depth, continuity, and angular orientation, wherein the combination of two or more groove features reduces ingoing nip spray. In yet another alternative embodiment, grooves 26 may be formed in a staggered pattern, such as in belt 17'shown in FIG. 12.

A shoe nip press belt having CD or transverse direction grooves has the advantageous effect of acting like the impeller or gear for a positive displacement pump. As the groove 26 enters the shoe, water is forced out of the web 20 and into the grooves 26 of the belt 17. Because the grooves 26 are formed in the resin 34, which is not water permeable, the water does not flow out of the grooves 26. As the pressure between the press roll 12 and the shoe increases, the grooves 26 are filed with water from the fibrous web 20. The movement of the belt 17 then carries the water forced into the grooves 26 away from the fibrous web 20.

Because the width (the MD component) of the grooves 26 is smaller than the length of the shoe, the water that enters the grooves cannot flow out and is kept in the grooves due in part to the high pressure applied by the press roll 12. Such an embodiment may prove very useful in low-speed applications where traditionally a plain or ungrooved belt is used. However, the present invention is not so limited, and may in fact be used at a variety of speeds.

Figure 13:
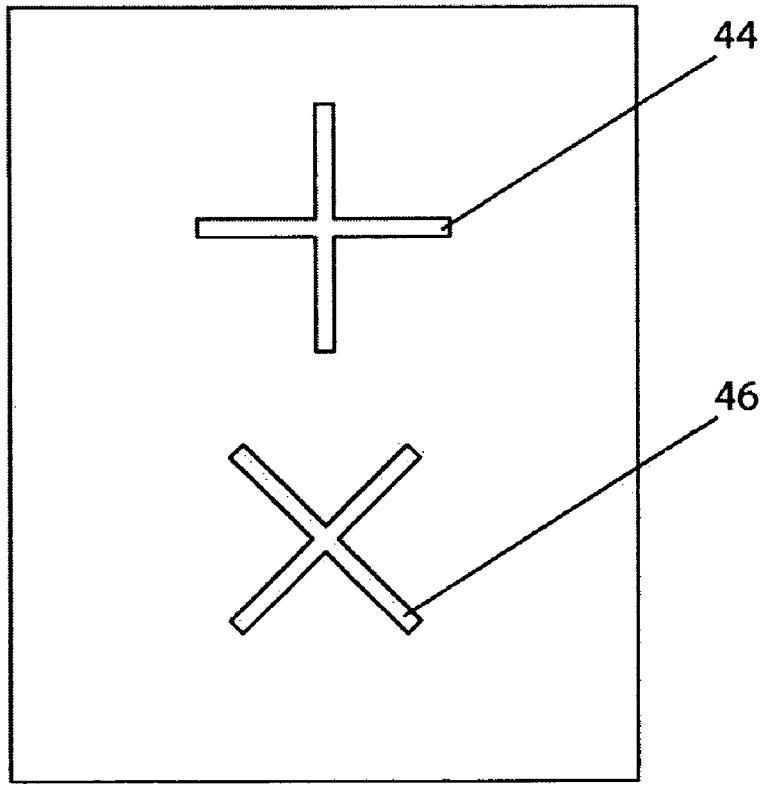
FIG. 13 is a top view of a belt having a plurality of grooves which are arranged in accordance with an embodiment of the present invention.

Additionally the present belt may have other patterns of non-continuous grooves. As an example, and with reference to FIG. 13, the present belt may have a number of first grooves (such as groove 44) and/or a number of second grooves (such as groove 46). Each of such grooves may have an overall length and width which is less than that of the arcuate pressure shoe 14.

Where the belt 16 (FIG. 2) is compared to a belt having standard-type continuous grooves, and where, the grooves of both belts have depths of 1.4 mm and widths of 0.8 mm, and the width of the land area (distance between adjacent grooves) is 2.1 mm, the ingoing nip spray and the outgoing nip spray can be measured and plotted against the machine speed and nip pressure exerted.

Figure 8:
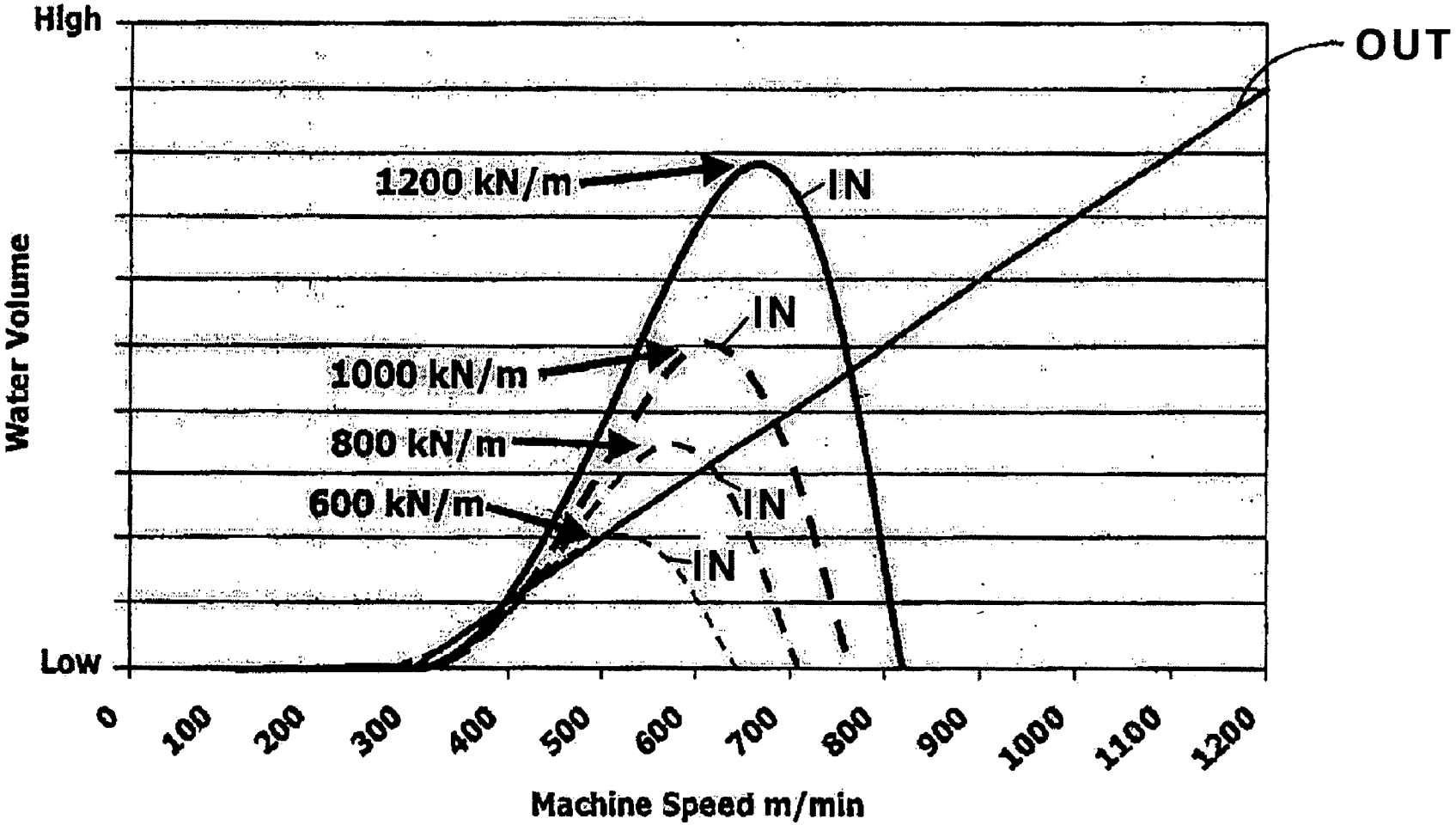
FIG. 8 is a diagram which illustrates the water volume of the ingoing and outgoing nip spay as a function of machine speed and press load of a belt having continuous grooves.

As can be seen in FIG. 8, with the standard continuous groove belts, there is ingoing nip spray at a machine speed of more than 300 m/min. In addition, as the speed increased the ingoing nip spray also increased and thereafter decreased as shown. Also, as the press load increased the ingoing nip spray increased. Accordingly, there is an operative range at which it is undesirable to operate a standard grooved shoe press belt.

Figure 9:
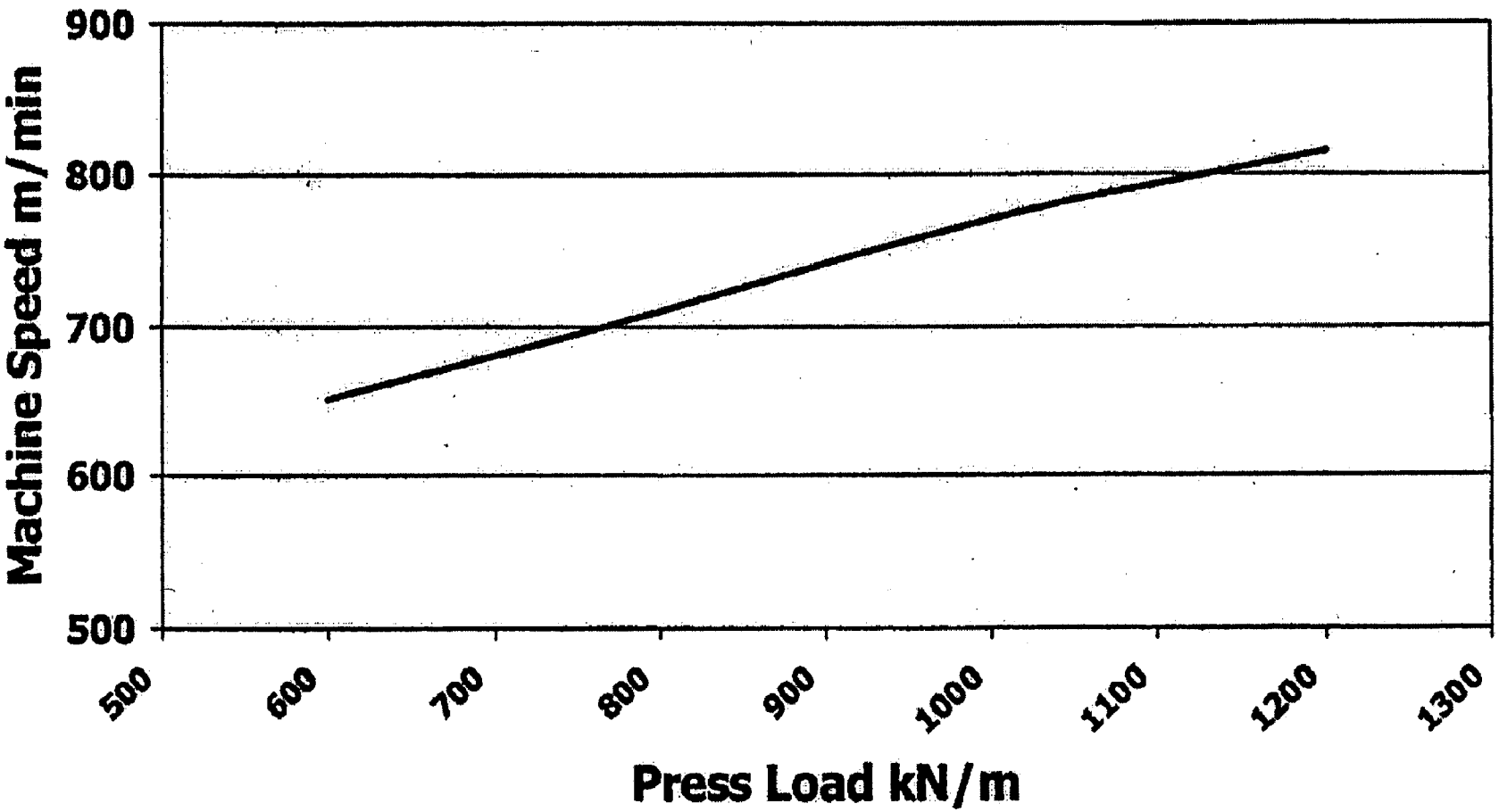
FIG. 9 is a diagram which illustrates the speed at which the ingoing nip spray disappears as a function of load for the press belt having continuous grooves.

FIG. 9 shows the speed of operation at which the ingoing nip spray is essentially eliminated as the belt enters the shoe nip press. The graph compares the speed at varying press loads in the shoe press belt with continuous grooves. It can be observed that as the press load increased, the speed necessary for the eliminating the ingoing nip spray increased. For example, at 600 kN/m press load the speed necessary for ingoing nip spray disappearance is approximately 650 m/min compared to approximately 810 m/min for ingoing nip spray elimination at a press load of 1200 kN/m.

As shown in FIGS. 8 and 9, the ingoing nip spray may be present in a long shoe press with a belt with standard-type continuous MD grooves that runs at speeds greater than about 650 m/min or less than 810 m/min when operating in the range of press loads between 600 kN/m and 1200 kN/m. The ingoing nip spray reduces the efficiency of web dewatering and is therefore an undesirable characteristic of known grooved belts.

Figure 10:
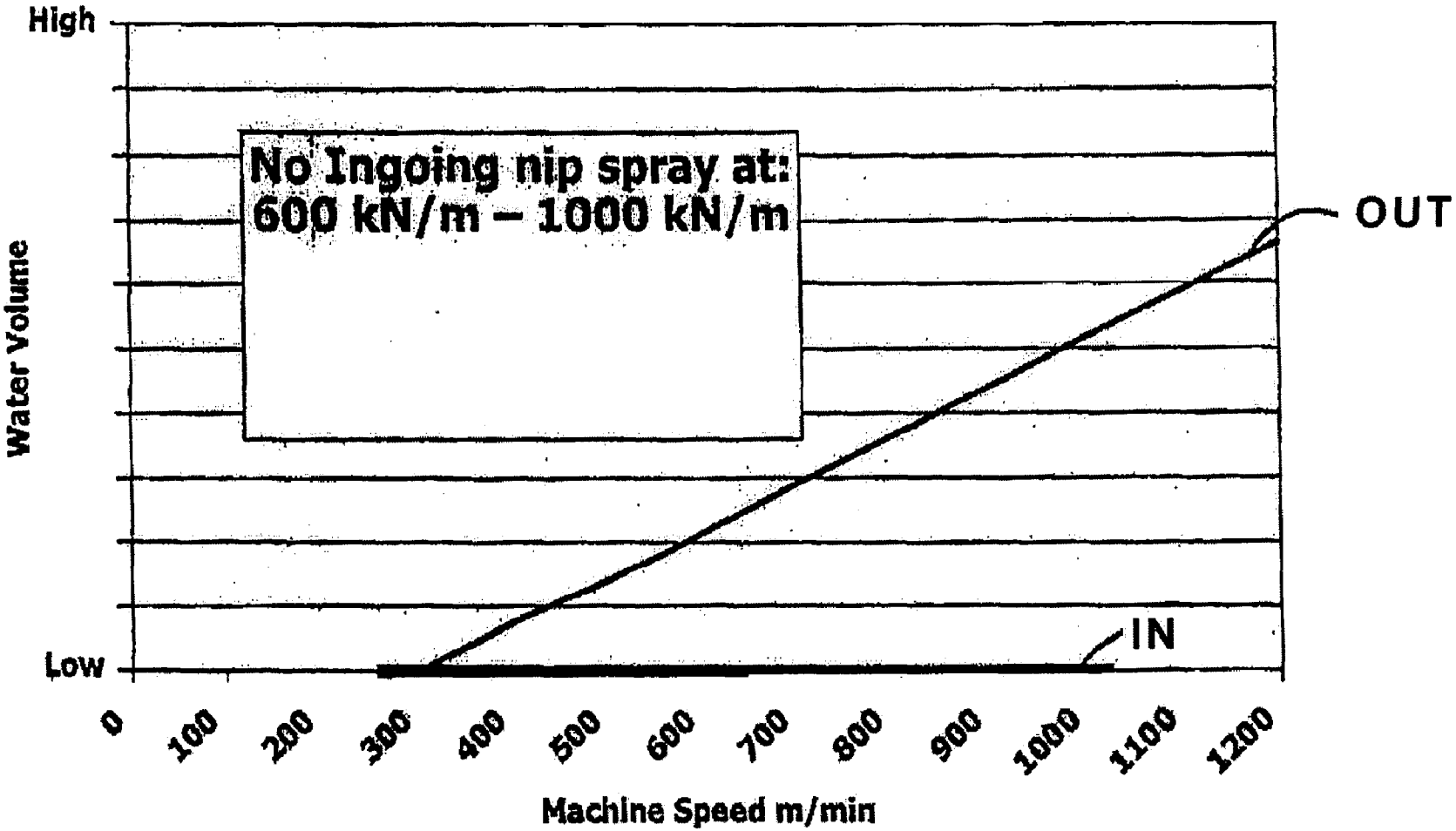
FIG. 10 is a diagram which illustrates the water volume of the ingoing and outgoing nip spay as a function of machine speed and load for a belt of the present invention.

In contrast, as indicated in FIG. 10, the belts of the present invention have no or substantially no ingoing nip spray at press loads of 600 kN/m-1000 kN/min between speeds of 250 m/min-1000 m/min. Accordingly, belts with discontinuous grooves reduce ingoing nip spray and thus can increase web dewatering efficiency.

Figure 14:
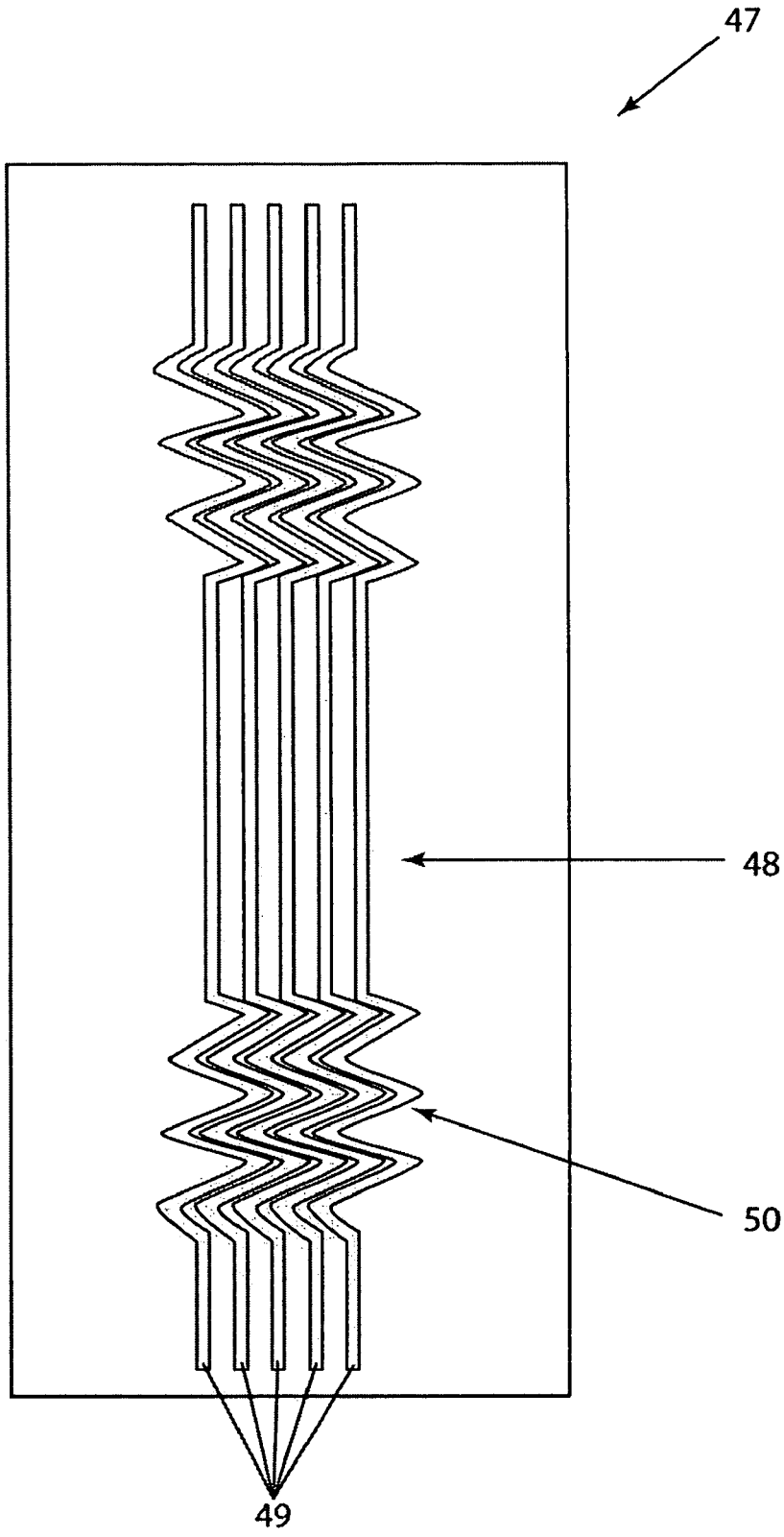
FIG. 14 is a top view of a belt having a plurality of grooves which are arranged in accordance with an embodiment of the present invention.
Figure 15:
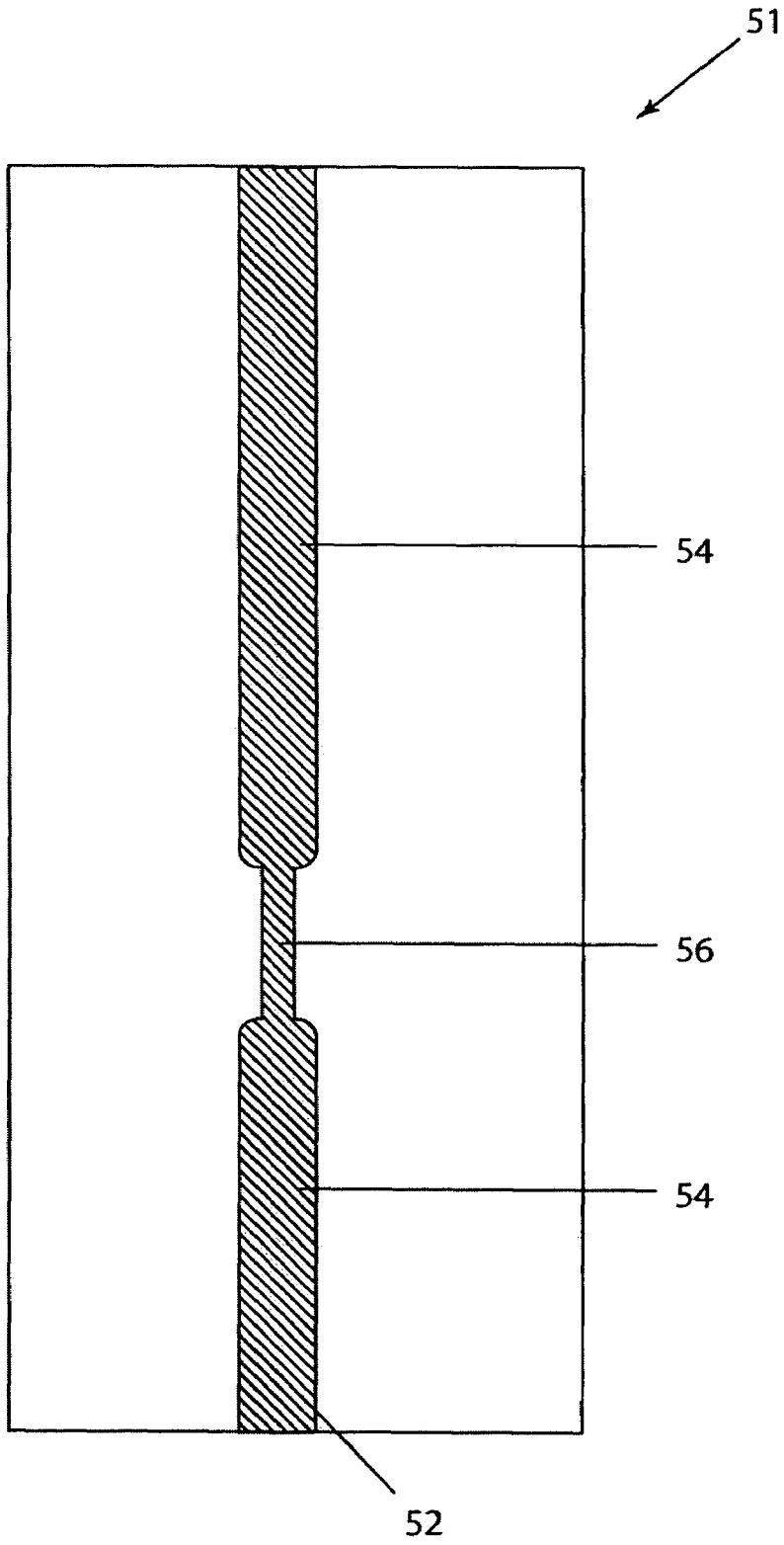
FIG. 15 is a top view of a belt in accordance with an embodiment of the present invention.
Figure 16:
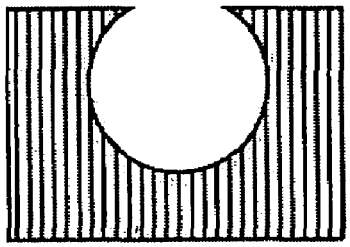
FIG. 16 is a cross-section of a groove in accordance with an embodiment of the present invention.
Figure 17:
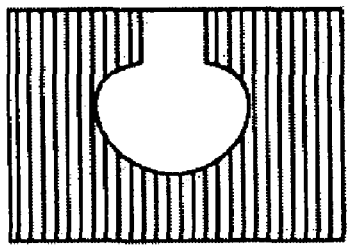
FIG. 17 is a cross-section of a groove in accordance with an embodiment of the present invention.
Figure 18:
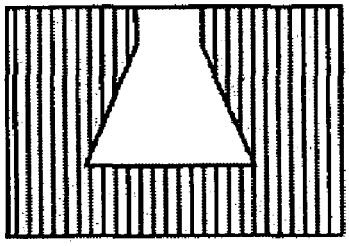
FIG. 18 is a cross-section of a groove in accordance with an embodiment of the present invention.
Figure 19:
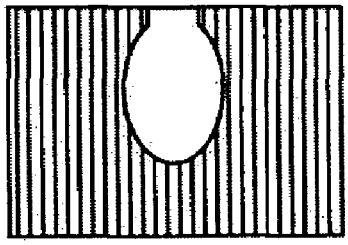
FIG. 19 a cross-section of a groove in accordance with an embodiment of the present invention.
Figure 20:
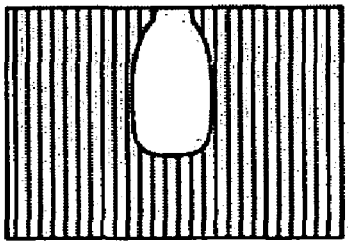
FIG. 20 is a cross-section of a groove in accordance with an embodiment of the present invention.
Figure 21:
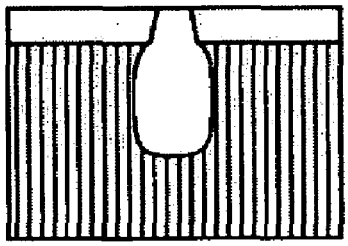
FIG. 21 is a cross-section of a groove in accordance with an embodiment of the present invention.

Although the present belt has been described as having discontinuous grooves, the present invention is not so limited. That is, the present belt may include non-standard type continuous grooves. As an example, and with reference to FIG. 14, a belt 47 may have a number of continuous grooves 49 each having a straight portion 48 followed by a zigzag portion 50 followed by another straight portion 48 and so forth. The length of the grooves in the straight and/or zigzag portions may each be less than the length of the arcuate pressure shoe 14. As another example, and with reference to FIG. 15, a belt 51 may have one or more grooves 52 each having a number of first portions 54 having a first width and a number of second portions 56 having a second width which is smaller than the first width. The length of second or restrictive portion 56 may be less than the length of the arcuate pressure shoe 14.

Furthermore, as previously indicated, the shapes of the grooves utilized in the present belt may have a number of different cross-sectional shapes. Examples of several of such cross-sectional shapes are shown in FIGS. 16-21. As is to be appreciated, the shapes of the grooves of the present belt are not limited to these shapes.

Figure 22:
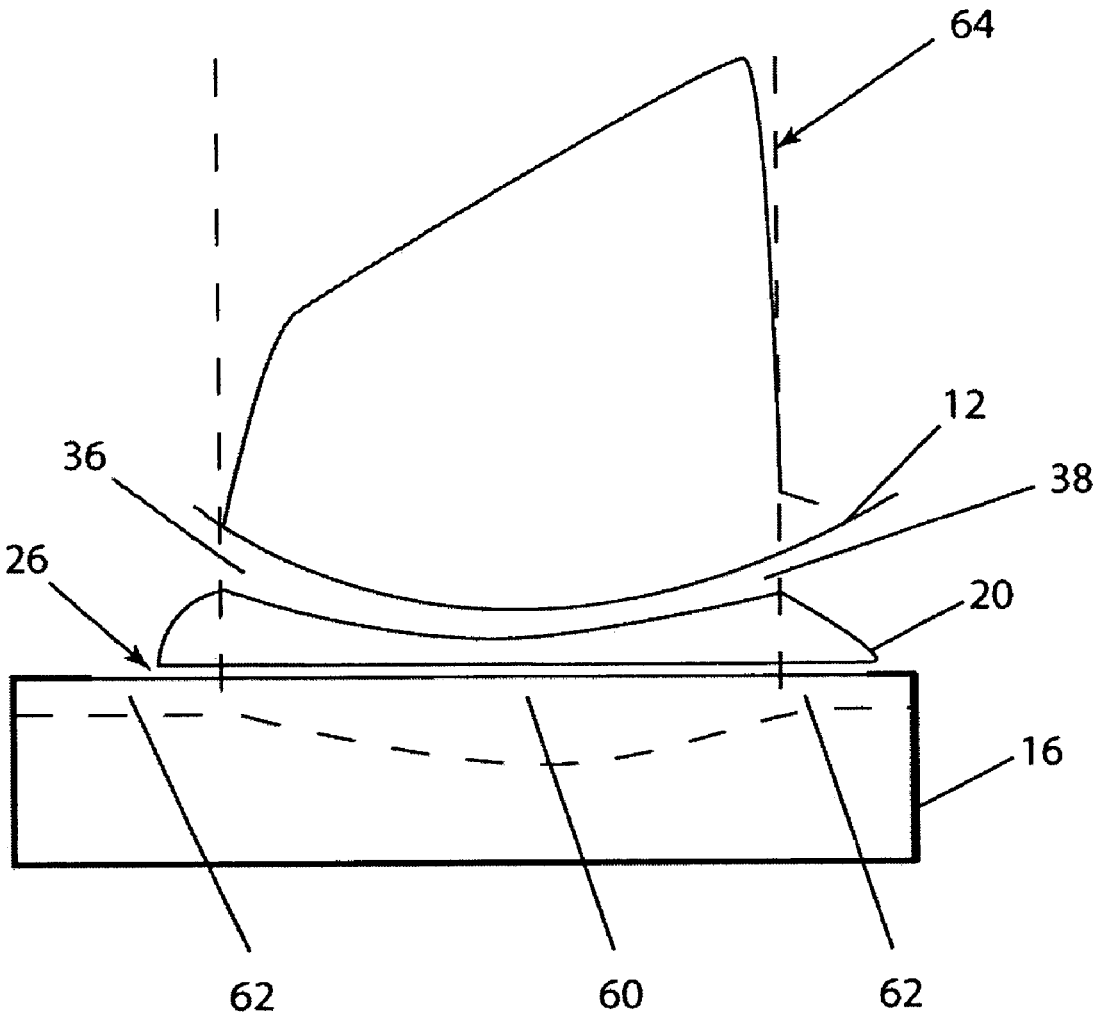
FIG. 22 is a cross-section of a shoe nip press and belt in accordance with another embodiment of the present invention.

A further advantageous embodiment of the present invention is shown in FIG. 22. In FIG. 22, the groove 26 is formed to a variable depth having a deeper groove section 60, and a shallower groove section 62. The change in depth acts substantially as the end of the groove in the non-continuous grooves discussed above. That is, the shallow portions 62 of the groove 26 prevents water from easily flowing out of deeper section of the groove 60, thereby significantly reducing the tendency of the water to flow in the direction opposite machine direction and therewith minimizing the nip spray.

The groove 26 in the present embodiment is continuous, however in one advantageous embodiment, the deeper groove portion 60 of the groove 26 has a length less than the length of the pressing zone of the shoe. This can be seen in comparison to the pressure curve 64 shown in FIG. 22 with the depth of the groove 26. At the entrance to the press roll 12, there is a low pressure area 36 which corresponds to a shallow section 62 of groove 26. Thereafter, the pressure rapidly rises and the depth of the groove 26 is increased in this area. The highest pressure occurs at a point shortly before the end of the deep section 60 of the groove 26.

Notice that in the area of shallow portions 62, the pressure falls off dramatically. Thus, in the deepest sections of the groove 26, where the highest pressure is experienced, the greatest amount of water is removed from the fibrous web 20. For clarity, FIG. 22 does not show a press fabric (18 of FIG. 1) on which the fibrous web 20 is carried, however, one of skill in the art will readily appreciate that such a fabric would typically be located between web 20 and the shoe press belt 16.

Modifications to the above would be obvious to those of ordinary skill in the art, but would not bring the invention so modified beyond the scope of the appended claims.

What is claimed is:

1. A belt for use in a shoe press comprising:

a base fabric;

a resin coating layer formed on said base fabric and substantially co-extensive therewith; and a plurality of discontinuous grooves formed in said resin coating layer, wherein at least one of said grooves includes a first portion having a width which is greater than a width of a second portion.

2. The belt according to claim 1, wherein the grooves are formed substantially in the machine direction.

3. The belt according to claim 1, wherein the grooves are formed substantially in the cross-machine direction.

4. The belt according to claim 1, wherein the grooves are formed at an angle relative to the machine direction.

5. The belt according to claim 2, wherein the machine direction length of said grooves is less than the machine direction length of a shoe portion of said long nip press.

6. The belt according to claim 3, wherein the cross-machine direction length of said groove is less than the cross-machine direction length of a shoe portion of said long nip press.

7. The belt according to claim 6, wherein the machine direction length of said groove is less than the machine direction length of a shoe portion of said long nip press.

8. The belt according to claim 1, wherein all of said grooves include a first portion which has a width which is greater than a width of a second portion.

9. The belt according to claim 1, wherein said grooves include a first portion which has a depth that is greater than a second portion of said groove.

10. The belt according to claim 1, wherein the grooves are parallel to one another and are off-set from one another in the machine direction by a uniform distance.

11. The belt according to claim 1, wherein the grooves are parallel to one another and are staggered from one another in a repeating pattern.

12. The belt according to claim 1, wherein the grooves are formed in the machine direction and cross-machine direction.

13. A belt for use in a shoe press comprising:

a base fabric;

a resin coating layer formed on said base fabric and substantially co-extensive therewith; and a plurality of discontinuous grooves formed in said resin coating layer, wherein the grooves are parallel to one another and are off-set from one another in the machine direction by a non-uniform distance.

14. A belt for use in a shoe press comprising:

a base fabric;

a resin coating layer formed on said base fabric and substantially co-extensive therewith; and a plurality of discontinuous grooves formed in said resin coating layer, wherein the grooves are parallel to one another and are staggered from one another in a non-repeating pattern.

15. A belt for use in a shoe press comprising:

a base fabric;

a resin coating layer formed on said base fabric and substantially co-extensive therewith; and a plurality of discontinuous machine direction grooves formed in said resin coating layer, wherein said grooves are formed of a combination of one or more groove features selected from the group consisting of groove shape, depth, and angular orientation, and wherein at least one of said grooves includes a first portion having a width which is greater than a width of a second portion to reduce ingoing nip spray.

16. A belt for use in a shoe press comprising:

a base fabric;

a resin coating layer formed on said base fabric and substantially co-extensive therewith; and a plurality of grooves formed in said resin coating layer, wherein said grooves are formed of a combination of one or more groove features selected from the group consisting of groove shape, depth, width, and angular orientation, wherein said grooves include a first portion which is straight and a second portion which is sinusoidal or zigzag, both of which extend substantially in the machine direction.

17. The belt according to claim 16, wherein all of said grooves are continuous and include a first portion having a width which is greater than a width of a second portion.

18. The belt according to claim 16, wherein said grooves include a first portion having a depth which is greater than a depth of a second portion.

19. A method of minimizing ingoing nip spray in a shoe press belt comprising the steps of:

providing a base fabric for a press belt;

depositing a polymeric resin on the base fabric; and forming a plurality of discontinuous grooves in said polymeric resin, wherein said grooves are formed of a combination of one or more groove features selected from the group consisting of groove shape, depth, and angular orientation, and wherein at least one of said grooves includes a first portion having a width which is greater than a width of a second portion to reduce ingoing nip spray.

20. A method of minimizing ingoing nip spray in a shoe press belt comprising the steps of:

providing a base fabric for a press belt;

depositing a polymeric resin on the base fabric; and forming a plurality of grooves in said polymeric resin, wherein said grooves are formed of a combination of one or more groove features selected from the group consisting of groove shape, depth, width, and angular orientation.

wherein said grooves include a first portion which is straight and a second portion which is sinusoidal or zigzag, both of which extend substantially in the machine direction.

21. The method to claim 20 wherein all of said grooves are formed continuous and include a first portion having a width which is greater than a width of a second portion.

22. The method according to claim 20 wherein said grooves are formed continuous and include a first portion having a depth which is greater than a depth of a second portion.

23. The method of claim 20 wherein the grooves are formed discontinuous and are separated by a land formed in the polymeric resin.

24. The method according to claim 23, wherein the grooves are formed substantially in the machine direction.

25. The method according to claim 23, wherein the grooves are formed substantially in the cross-machine direction.

26. The method according to claim 23, wherein the grooves are formed at an angle relative to the machine direction.

27. The method according to claim 24, wherein the machine direction length of said grooves is less than the machine direction length of a shoe portion of said long nip press.

28. The method according to claim 25, wherein the cross-machine direction length of said groove is less than the cross-machine direction length of a shoe portion of said long nip press.

29. The method according to claim 24 wherein the machine direction length of said groove is less than the machine direction length of a shoe portion of said long nip press.

30. The method according to claim 23, wherein all of said grooves include a first portion which has a width which is greater than a width of a second portion.

31. The method according to claim 23, wherein said grooves include a first portion which has a depth that is greater than a second portion of said groove.

32. The method according to claim 23, wherein the grooves are formed parallel to one another and are off-set from one another in the machine direction by a uniform distance.

33. The method according to claim 23, wherein the grooves are formed parallel to one another and are off-set from one another in the machine direction by a non-uniform distance.

34. The method according to claim 23, wherein the grooves are formed parallel to one another and are staggered from one another in a repeating pattern.

35. The method according to claim 23, wherein the grooves are formed parallel to one another and are staggered from one another in a non-repeating pattern.

36. A belt for use in a shoe press comprising:

a base fabric;

a resin coating layer formed on said base fabric and substantially co-extensive therewith; and a plurality of continuous cross-machine direction grooves formed in said resin coating layer, wherein said grooves are formed of a combination of two or more groove features selected from the group consisting of groove shape, depth, width and angular orientation.

37. The belt according to claim 36, wherein all of said grooves include a first portion which has a width which is greater than a width of a second portion.

38. The belt according to claim 36, wherein the grooves are parallel to one another and are off-set from one another in the machine direction by a uniform distance.

39. The belt according to claim 36, wherein the grooves are parallel to one another and are off-set from one another in the machine direction by a non-uniform distance.

40. The belt according to claim 36, wherein the grooves are parallel to one another and are staggered from one another in a repeating pattern.

41. The belt according to claim 36, wherein the grooves are parallel to one another and are staggered from one another in a non-repeating pattern.

42. 36 A belt for use in a shoe press comprising:

a base fabric;

a resin coating layer formed on said base fabric and substantially co-extensive therewith; and a plurality of continuous cross-machine direction grooves formed in said resin coating layer, which also includes a plurality of discontinuous machine direction grooves formed in the resin coating layer.

43. A method of minimizing the ingoing nip spray in a shoe press belt comprising the steps of:

providing a base fabric for a press belt;

depositing a polymeric resin on the base fabric; and forming a plurality of grooves in said polymeric resin, wherein at least one of said grooves includes a first portion having a width which is greater than a width of a second portion.

44. The method according to claim 43, wherein said grooves are continuous in a machine direction or cross-machine direction of the belt.

45. The method according to claim 43, wherein said grooves are discontinuous in a machine direction or cross-machine direction of the belt.

46. A belt for use in a shoe press comprising:

a base fabric;

a resin coating layer formed on said base fabric and substantially co-extensive therewith; and a plurality of discontinuous grooves formed in said resin coating layer, wherein said grooves include a first portion which is straight and a second portion which is sinusoidal or zigzag, both of which extend substantially in the machine direction.

47. A belt for use in a shoe press comprising:

a base fabric;

a resin coating layer formed on a face side of said base fabric and substantially co-extensive therewith; and a plurality of discontinuous cross-machine direction grooves formed in said resin coating layer, which remain open in operation.

48. A belt for use in a shoe press comprising:

a base fabric;

a resin coating layer formed on a face side of said base fabric and substantially co-extensive therewith; and a plurality of discontinuous cross-machine direction grooves formed in said resin coating layer, which also includes a plurality of discontinuous machine direction grooves formed in the resin coating layer.

49. A belt for use in a shoe press comprising:

a base fabric;

a resin coating layer formed on said base fabric and substantially co-extensive therewith; and a plurality of discontinuous grooves formed in said resin coating layer, wherein said grooves are formed substantially in the machine direction and said grooves have a varying width and varying depth along a length thereof.

50. A belt for use in a shoe press comprising:

a base fabric;

a resin coating layer formed on said base fabric and substantially co-extensive therewith; and a plurality of discontinuous grooves formed in said resin coating layer, wherein said grooves are formed substantially in the cross-machine direction and said grooves have a varying width and varying depth along a length thereof.

51. A belt for use in a shoe press comprising:

a base fabric;

a resin coating layer formed on said base fabric and substantially co-extensive therewith; and a plurality of discontinuous grooves formed in said resin coating layer, wherein the grooves are formed substantially in the machine direction, wherein the machine direction length of said grooves is less than the machine direction length of a shoe portion of said long nip press, and wherein at least one of said grooves has a varying depth along its length.

52. The belt according to claim 51, wherein said grooves have a same or different length in machine direction.

* * * * *

UNITED STATES PATENT AND TRADEMARK OFFICE

CERTIFICATE OF CORRECTION

PATENT NO. : 7,387,711 B2
APPLICATION NO. : 10/988903
DATED : June 17, 2008
INVENTOR(S) : Fitzpatrick et al.

It is certified that error appears in the above-identified patent and that said Letters Patent is hereby corrected as shown below:

Col. 13, claim 42 delete the number "36" in the beginning of Claim 42.

Signed and Sealed this

Fourth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,387,711 B2
APPLICATION NO. : 10/988903
DATED : June 17, 2008
INVENTOR(S) : Fitzpatrick et al.

It is certified that error appears in the above-identified patent and that said Letters Patent is hereby corrected as shown below:

Col. 13, claim 42, line 55, delete the number "36" in the beginning of Claim 42.

This certificate supersedes the Certificate of Correction issued November 4, 2008.

Signed and Sealed this

Twenty-fifth Day of November, 2008

JON W. DUDAS
*Director of the United States Patent and Trademark Office*